US006119898A

United States Patent [19]

Dark

[11] Patent Number: 6,119,898

[45] Date of Patent: Sep. 19, 2000

[54] TAMPER EVIDENT SPOUT

[76] Inventor: Richard C. G. Dark, 2248 Gum Tree La., Fallbrook, Calif. 92028

[21] Appl. No.: 09/328,703

[22] Filed: Jun. 9, 1999

[51] Int. Cl.[7] ..... B67D 3/00

[52] U.S. Cl. ..... 222/153.06; 222/153.14; 222/528; 222/536; 222/541.5

[58] Field of Search ..... 222/153.06, 153.14, 222/541.5, 528, 529, 534, 536

[56] References Cited

U.S. PATENT DOCUMENTS

| | | | |
|---|---|---|---|
| 3,655,099 | 4/1972 | Hazard | 222/153.06 |
| 4,081,108 | 3/1978 | Wilson | 222/153 |
| 4,440,327 | 4/1984 | Dark | 222/530 |
| 5,141,150 | 8/1992 | Plaessman | 222/123.3 |
| 5,356,044 | 10/1994 | Lavange | 222/153.06 |
| 5,392,968 | 2/1995 | Dark | 222/529 |
| 5,662,245 | 9/1997 | Grant | 222/153.14 X |
| 5,799,840 | 9/1998 | Mogard | 222/541.5 |
| 5,875,907 | 3/1999 | Lay | 222/153.06 X |

*Primary Examiner*—Kenneth Bomberg
*Attorney, Agent, or Firm*—Ronald M. Goldman

[57] ABSTRACT

A tamper evident spouted closure, contains a base (1) supporting a pivotally mounted spout (4). A tab (7) is integrally connected to a pair of frangible webs (6) and those webs are serially integrally connected to the distal end of said spout, the webs and tab extending from the spouts end. A tab seat (10) is integrally formed in the closure base and a weld permanently joins the tab to the seat. The frangible web thereby obstructs the initial movement to lift and open the spout. When the spout is pulled open, the frangible web easily breaks. The broken web serves as visual evidence that the spout was previously opened and then re-closed.

19 Claims, 2 Drawing Sheets

TAMPER EVIDENT SPOUT

FIELD OF THE INVENTION

This invention relates to tamper evident spout type dispensing closures and, more particularly, to making a dispensing closure's pivotable spout tamper evident, whereby a visual indication is given as to whether or not the closure has previously been opened.

BACKGROUND

Most if not all packaged consumables marketed today at retail, including those in bottles and dispensers, contain a tamper evident device of some sort that enables a purchaser of those articles to determine if someone else previously opened and re-closed the package. If nothing else, due to the presence of that visible feature, the purchaser gains confidence that a miscreant has not tampered with the purity or amount of the packaged product and feels assured of the product's integrity.

Most closures seen in the marketplace, apart from the dispensing type closures, such as a screw-on type soda bottle cap, contain a tamper evident ring surrounding the base of the closure. That ring is connected to the closure by fragmentable webs. When the closure is assembled to the bottle, the tamper evident ring snaps in place over a corresponding ring formed on the neck finish of the bottle, latching the tamper evident ring in place. When the bottle cap is initially twisted to unscrew it from its place on the bottle, the tamper evident rings stays engaged to the bottle's neck, while under that twisting force the fragmentible webs break free from the closure. That broken web gives evidence that the closure has been opened. Should the purchaser encounter a soda bottle on the store shelf containing such a broken web, the purchaser knows that it's best to leave it remain.

Different from bottle caps, pouring spouts on packages of granulated materials and food stuffs are similarly protected by a frangible tape covering the pouring spout and a portion of the package wall supporting the spout. The consumer must remove or tear off that tape to pivot the spout open, leaving a tell-tale reminder that the package has been opened. Such a tamper evident spout arrangement is shown in the patent literature in the patent to Plaessman, U.S. Pat. No. 5,141,150 granted Aug. 25, 1992, entitled Pouring Spout.

Closures containing spouts are very different in construction from a pouring spout contained in a package and a screw-on plastic bottle cap. Like the bottle cap earlier referred to, the closure is assembled together from one or more component elements, one of which is a pivotable spout that is normally pivoted closed. Thereafter, that closure is attached to or otherwise mounted to a filled container to close the container and seal its contents inside. Typically, the closure is formed of a co-polymer polypropylene material, a plastic. The container associated with the closure is formed of a variety of available materials, such as a plastic, glass, or the like.

Providing a tamper evident spouted closure has not been self-evident. As example, as suggested by the earlier cited Plaessman '150 patent, one might seek to loop a length of a frangible adhesive tape over the spout and down along the sides of the container. That tape would be torn or broken when raising the spout to the open position. However, it is speculated that adhesive tape does not appear to adhere sufficiently well to some plastics as would reliably accomplish that. Like steaming a postage stamp from a letter, it is possible to tamper with a tape label in a similar manner to remove and replace the label without showing any evidence of tampering. For whatever reason, a tape is not known to be acceptable in the industry to show tampering of plastic closures.

Another approach to give evidence of tampering for spouted closures is offered in a patent to Wilson et al, U.S. Pat. No. 4,081,108, granted Mar. 28, 1978, entitled Tamper Evident One-Piece Dispensing Closures. The spout in Wilson's closure is one which pivots between an open position, with the spout raised upright, and a closed position, with the spout pivoted down, horizontal. In the structure disclosed in Wilson the closure and web are molded in one-piece. In that single piece, the pivotable spout for the closure is formed with its distal end secured by a frangible strap to the closure base, forming a string of serially attached elements. However, the rear or proximal end of the spout, the end which is intended to pivot during opening and closing, remains unconnected or free, as retrieved from the mold, and must be assembled into place to the pivots in an opening in the closure base.

During the assembly process, the spout is rotated over so that its rear end faces an opening in the closure base, instead of facing away, and, incident thereto, bends the strap over into a loop. Trunions or pivot shafts located at the proximal end of the spout are moved into the entrance in the closure base and are forced into place within pivot sockets in the cavity, essentially snap fitting the rear end of the spout in place. As thus assembled closed, the strap between the end of the spout and the closure base is unbroken.

Should one pull up on the spout to pivot the spout upright and thereby open the container, as is the normal procedure, the frangible strap breaks apart, leaving evidence that the closure has once been opened. The drawback is that should the pivot shaft be popped or snapped up from its seat in the cavity, the proximal end of the spout can be lifted out from the closure base, exposing the contents of the associated container, without breaking the frangible strap. A devious knowledgable individual could thus remove the spout from its seat, tamper with the container's contents and replace the spout to its pivot seat in the closure, without leaving evidence of tampering.

Although a purchaser observing the unbroken strap may gain confidence that the contents have not been tampered with, that confidence is undeserved, since the tamper evident feature is illusory. Wilson et al cannot ensure that the spout cannot be removed and reassembled in place. As an advantage, the present invention provides a tamper evident feature for a spouted closure that, unlike the structure in Wilson et al. cannot be defeated.

A better spouted closure, one in which the rear end of the spout cannot be removed from the closure base, is described in my prior patent U.S. Pat. No. 5,392,968 granted Feb. 28, 1995, entitled Dispensing Closure and Method, and also in that of my prior patent U.S. Pat. No. 4,440,327, hereafter sometimes referred to as the "Dark" patents. My '968 patent shows a closure in which a pivotal spout is pivotally connected along its lower end to the closure base by a hinge with other portions of that lower end are connected through an invertible diaphragm system to the closure base. The spout is open when the spout is raised or pivoted to an upright position; and it is closed by pivoting the spout over to a horizontal position, moving a portion of the diaphragm there with. Spouted closures incorporating the construction described in the Dark patents have previously been marketed by the Allied Mold and Die Company, Fontana, Calif., and are often referred to as the "invertible diaphragm" closure.

As described in the Dark patent, the closure is molded in one-piece from plastic material. Because the lower end of the spout is thus permanently attached directly and indirectly to the closure base, the spout's bottom end cannot be removed from the closure's base portion, unlike that spout shown in the Wilson et al closure. Because Wilson's technique requires that the proximal end to the spout initially be detached, it is not possible to employ Wilson's technique with spouted closures of the kind described in the Dark patent.

Accordingly, a principal object of my invention is to provide a tamper evident device for a closure that contains a non-detachable pivotable dispensing spout.

And a further object of my invention is to provide a tamper evident spouted closure with a tamper evident device that cannot be defeated.

SUMMARY OF THE INVENTION

In accordance with the foregoing objects and advantages, a tamper evident closure, contains a base supporting a pivotally mounted spout, the spout being pivoted closed lying across the bass when first assembled. A tab is integrally connected at one end to a frangible web and that web is serially integrally connected to the distal end of said spout with the spout initially in the closed position. The base contains a tab seat integrally formed therein and a weld permanently joins the tab to the tab seat, thereby placing the frangible web in a position to obstruct movement of the spout. When the spout is pulled up to open the closure, the frangible web easily breaks. The broken web serves as visual evidence that the spout has once been lifted. Even though the spout is re-closed, the web remains broken and the visual evidence remains. Since the spout cannot be removed without either breaking the web or destroying the closure entirely, the foregoing tamper evident feature is defeat proof.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENT

Figure 1:
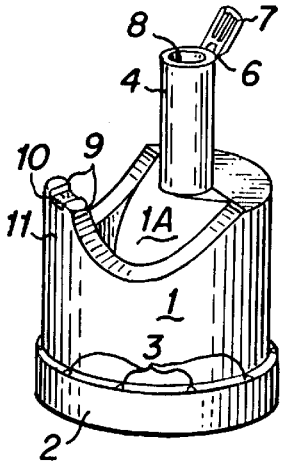
FIG. 1 is a perspective view of the tamper evident spouted closure in open and unassembled condition as removed from the mold.

Reference is made to FIG. 1 which shows a tamper evident spouted closure or, as more specifically termed, bottle cap 1 constructed in accordance with my invention in a configuration that is ready for final assembly. The closure is in the form of a cap for a bottle as might contain a drinking beverage or another liquid ingredient and, as is conventional practice, is constructed of molded plastic material, such as co-polymer polypropylene. As later herein described in greater detail, the cap is molded in one piece, a unitary one-piece assembly, and, as removed from the mold, the cap is in the open position as illustrated in FIG. 1. At the bottom end, the cap includes a cylindrical shaped tamper evident ring 2 that is attached by fragmental webs 3 located at the upper end to the bottom cylindrical wall of the closure base.

The internal walls of the closure base 1 define a hollow region on the underside accessible from below, not illustrated, and those walls contain a molded screw thread, also not illustrated, to enable the closure to be screwed into place atop a screw type bottle. An illustration of that internal structure is presented in my prior patent U.S. Pat. No. 5,392,968 and is incorporated herein by reference.

Ring 2 and its attachment web 3 are of the conventional structure, earlier referred to, that have been used heretofore to fit screw-on plastic caps to bottles. Once the closure is screwed onto a bottle, the ring locks into place on the bottle top. Hence, any attempt to access the bottle's content by twisting off cap 1, leaves visible evidence of that attempt, since the webs 3 will then be broken.

The cap contains a pivotable spout 4, shown in the raised open position. The spout contains a central passage 8 that extends through to the underside of the base. When the spout is in the open position, the central passage opens to permit ingredients to flow from the underside of the closure and through the passage. A hinge or pivot 5 is formed in the material and runs along a side of the spout, permitting the spout to be rotated down from the vertical to a horizontal position. Apart from the hinge, the bottom end of the spout is connected to a flexible and/or deformable diaphragm system 1A, which I refer to as a compound diaphragm. The preferred diaphragm system structure and the internal valving employed in this cap is that described and illustrated in the Dark patent U.S. Pat. No. 5,392,968 granted Feb. 28, 1995, entitled Dispensing Closure and Method, which is incorporated herein in its entirety by reference and need not be repeated. The Dark '968 patent also describes the manner in which the closure is fabricated in one piece forming a unitary one-piece assembly, all of which is incorporated herein by reference. Spout 4 is formed together with and is integrally attached thereby to the closure base.

Figure 2:
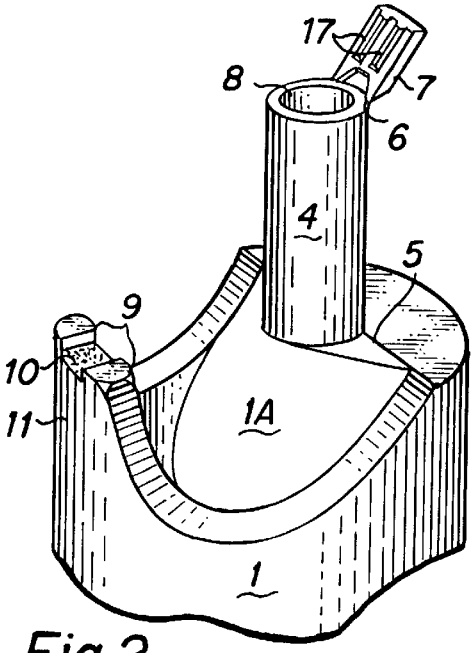
FIG. 2 is an enlarged partial perspective view of the upper portion of FIG. 1 that better illustrates the physical details of the tamper evident web and its seat within the closure prior to completion of assembly.

At its distal end spout 4 carries the tamper evident web 7, which is illustrated in enlarged scale in the partial view of FIG. 2 to which reference is made. Web 7 is connected at one edge to a portion of the spouts cylindrical edge by frangible webs 6, only one of which is numbered. The opposite end of the edge is unattached. Each web 6 is of a triangular shape and the the apex or pointed end of each triangular portion is integrally connected to the peripheral edge of spout 4. The triangular configuration permits the attachment to be accomplished with a minimal amount of material, thereby making the attachment with the spout's edge extremely fragile and easily broken to facilitate normal closure operation initially by the user.

Figure 3:
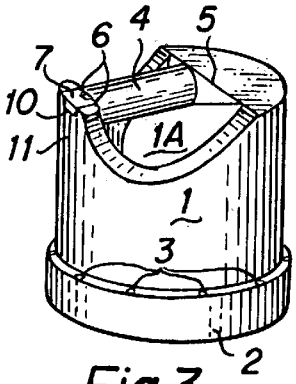
FIG. 3 illustrates the closure of FIG. 1 in closed and fully assembled condition.

The closure base includes a spout latch portion 11, a section or region of the outer wall of the closure base. That portion includes a pair of spaced short upright protrusions 9 defining there between a seat or weld area 10, recessed vertically from the ends of the protruding prongs 9 that serve as guides for aligning the tab. As those skilled in the art appreciate, the inclusion of upright protrusions 9, though preferred, is discretionary. In other less preferred embodiments those protrusions may be omitted, leaving a flat weld area. Weld area 10 appears as flat surface that is indented slightly from the outer surface or tips of protrusions 9. In this embodiment, weld area 10 is just sufficient in width to receive therein the free end of tab 7, which is placed between the protrusions 9, such as illustrated in FIG. 3, to which reference is made.

As fully assembled, the cap is closed and spout 4 is pivoted down as shown about hinge line 5 to its closed position, appearing horizontal as illustrated. In so doing, the bottom end of the spout swivels the flexible compound diaphragm system 1A about, as described in the Dark '968 patent, and closes an internal valve, not illustrated, located inside the closure base. The center line or axis of seat 10 lies in the plane of rotation or pivot defined by rotation of the axis of spout 4. In pivoting into the closed position, the spout carries the tab 7 into a position overlying seat 10, and is ready for attachment to that seat. In the preferred embodiment the attachment is accomplished by ultrasonic welding which forms a weld joint permanently fastening the tab to the seat.

Ultrasonic welding of plastics is a common process for joining two plastic parts together. The welding equipment employs a high frequency energy generator that propagates ultrasonic vibrations into a plastic component via a horn. The two plastic parts or components to be welded together requires that one of those components be held while the other component placed in contact therewith is vibrated at high frequency. The high frequency vibrations imparted to the component creates friction between the adjoining surfaces of the components, creating heat. The heat builds up between the two parts to a sufficient degree as melts the adjacent plastic material and the two components fuse or bond together creating a weld joint. Ultrasonic welding equipment for performing the foregoing bonding is widely available from different companies, such as the Branson Ultrasonics Corporation of Danbury, Connecticut.

Reference is again made to the enlarged partial view of FIG. 2, showing the upper portion of the closure as removed from the molding apparatus. As shown, the underside surface of tab 7 contains a pair of longitudinally extending small raised ribs 17. Those ribs are very short in height bing approximately 0.02 inches high. Those ribs serve as an ultrasonic energy director, as later herein discussed in greater detail. The surface of weld surface 10 is textured; it's surface is irregular containing depressions that are approximately three thousandths (0.003) of an inch to five thousandths (0.005) of an inch deep.

In many cases and in the illustrated embodiment, an energy director is incorporated into the plastic component to aid in ultrasonic welding. The energy director is a raised portion of the plastic component that is to come in contact with the other component to which it is to be welded. The high frequency energy applied to the one component passes through such energy director to localize the area at which the frictional heat is generated. The roughened or textured surface to the seat enhances friction and, hence, expedites the build up of heat between the two contacting surfaces.

In preparation for welding, spout 4 is closed, which places the attached tab 7 in a position overlying seat 10. For welding, thus, the closure is placed in and held in the welding apparatus, the welding head presses down against the upper surface of the tab, placing ribs 17 in contact with the textured surface of seat 10 and ultrasonic energy is applied. The ensuing ultrasonic energy is directed through the tab material and through the underlying ribs, the energy directors, vibrating those ribs against the roughened seat surface. The heat builds up sufficient to melt the ribs and the textured surface, which flow together and fuse or, as variously termed, bond together to make a unitary welded component, as the ultrasonic energy is withdrawn. Effectively, the fused portions constitute a plastic weld joint; the material that formed the depending ribs dissolves into and forms part of that weld joint.

To secure a weld when an energy director is not employed, a shear joint may be used, which, though less preferred, may be used in alternative embodiments. A shear joint consists of an interference fit between the two parts to be weld. Such an interference fit may be obtained in the foregoing tab and seat structure, as example, by forming the tab 7 slightly wider than the seat area 10 and incorporating a slight angle on the sides of tab 7 and seat 10 whereby the tab, when engaged in the seat area, cannot fully fit down to the bottom of the seat. When ultrasonic energy is applied to tab 7 through the sides of seat 10 it causes friction. The heat thereby generated welds the seat and tab together. That technique and structure is more likely to show some melted plastic on the top surface where the two parts are cwelded together, and, for that reason it is less preferred.

Figure 4:
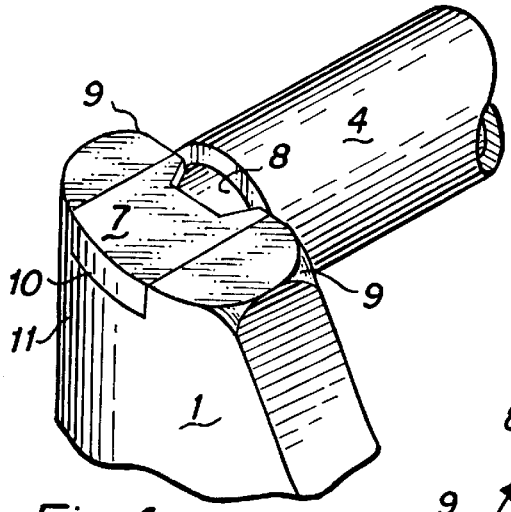
FIG. 4 is a enlarged partial perspective view of the upper front portion of FIG. 3 showing the elements of FIG. 2 as they appear following assembly.

Following welding, the final position of the welded tab and seat elements of the closure is better illustrated in the enlarged partial view of FIG. 4 to which reference is made. As shown in FIG. 4, tab 7 is located within weld area 10. Its length is sufficient to reach from the spout to the outer periphery of the outer wall of the spout latch portion 11 when the spout is closed. Its outer edge conforms to the shape of the outer wall of spout latch portion 11. The length of the spout is sufficient to reach the inside edge of the protrusions 9, but the outer circular edge of spout 4 should not contact the sides of the protrusions or the inside wall of spout latch portion 11. As shown, the mechanical series connection of tab and web form a mechanical connection or strap between the spout and the closure base, more specifically, the tab seat on the closure base.

The assembled cap may then be fastened to a bottle, not illustrated, that has been filled with the liquid ingredient. Typically this is accomplished at the bottling facilities of the product's manufacturer. The foregoing closure is separately manufactured by a closure manufacturer and is delivered to the bottler for assembly to the bottle.

Figure 5:
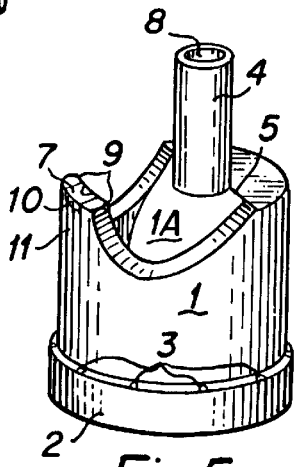
FIG. 5 illustrates the closure of FIG. 3 with the spout oriented to the upright dispensing position and the tamper evident tap broken, providing visual evidence of the opening.
Figure 6:
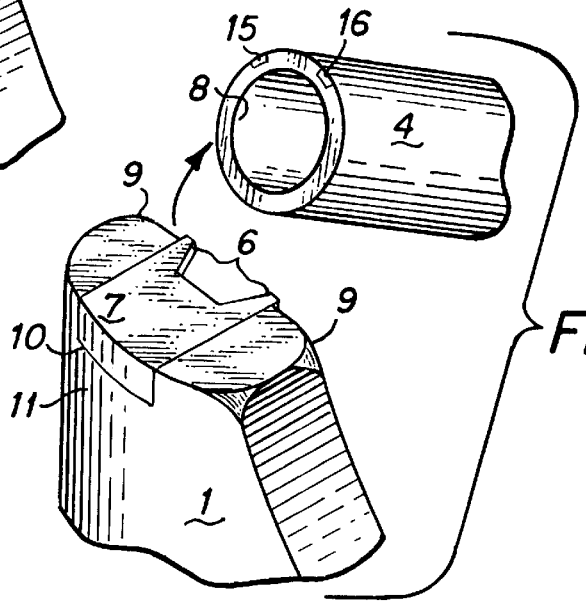
FIG. 6 illustrates the change that occurs in the elements of FIG. 4 as the spout is being raised to open the closure and the visible evidence produced thereby.
Figure 7A:
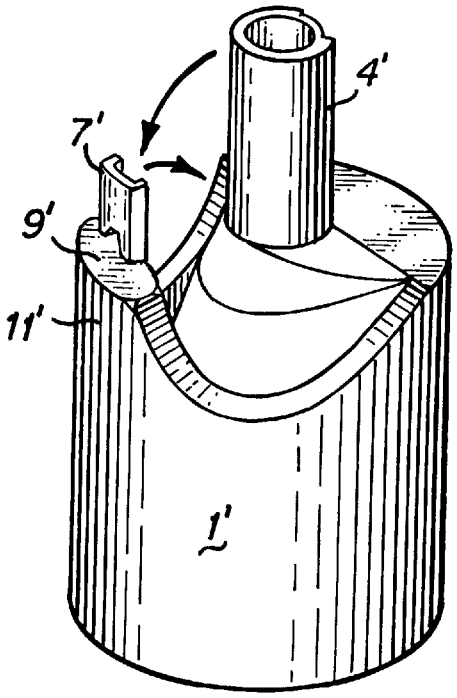
FIGS. 7A–7D illustrate the corresponding views of an alternative embodiment of the tamper evident spout.
Figure 7B:
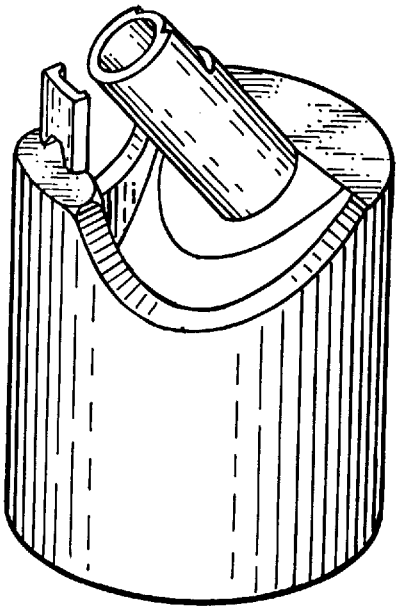
Figure 7C:
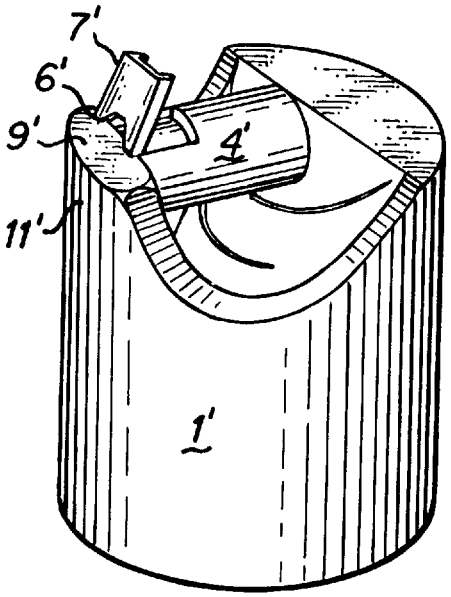
Figure 7D:
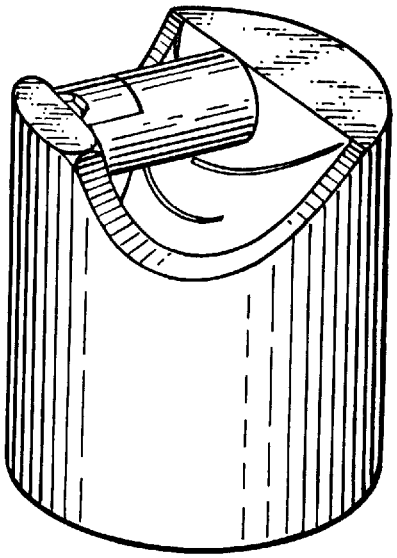

To open the closure, one simply grips spout 4 with one's fingers and pulls the distal end of the pivot away from its closed position. When fully open, the spout is in the position of FIG. 5 while the tab 7 remains attached to the closure base. As represented in enlarged view in FIG. 6, in pulling the spout away from the closed position, the force breaks the frangible webs 6, tearing the end of the spout away. This leaves marks or rough textured surface areas 15 and 16 in the end edge of the spout 4 and a frayed pointed end to webs 6, the latter of which serves as a visible indication that the spout had once been pivoted up. Upon re-closing the spout, the frictional engagement between the end marks 15 and 16 on the spout engages the broken pointed ends of the webs 6 to assist in holding the spout down. However, the existence of a line or break between those pointed ends and the end edge of the spout is sufficient to indicate to anyone that the web was previously broken as might indicate tampering.

As described in the cited Dark patents, the closure is formed in one piece by molding, forming a one-piece integral assembly defining the closure elements. Typically, the mold comprises two steel mold parts that mate together to define the structure being molded, such as described in the Dark patent. It is appreciated that the foregoing tamper evident closure structure is molded in the same manner as the existing closures, such as those closures incorporating the invention described in the Dark patents previously marketed by Allied Mold and Die Company, Fontana, Calif. Only slight changes need be made to the dies or molds of an existing mold for a pivotally spouted closure molded in one-piece, such as the unitary one-piece pivotally spouted closure described in the cited Dark patents and marketed by the Allied Mold & Die company, to add the disclosed tamper evident feature.

As example, a slight extension is added to the mold to define the short tab 7 and associated webs 6 as integrally extending from spout 4, by cutting away a small amount of additional steel from the mold, and in that cut-out region, shaping the part of the mold surface for the underside of the tab to define the longitudinally extending ribs 17. Likewise the seat 10 is obtained by cutting some material away from a single upper edge of the closure base at 11 to simultaneously define the tab seat 10 and the adjacent protrusions 9 on each side of that seat and then roughening the texture of the seat area in the steel mold. Other minor changes to the mold are possible as becomes apparent to those skilled in the molding art upon reading this specification.

For a practical embodiment the preferred plastic material preferred is a co-polymer polypropylene, more specifically a rubber modified co-polymer. Polypropylene is a member of the Polyolefin family, many of which can be used for the disclosed closures. The properties of polypropylene are such that thick sections are relatively rigid, thinner sections are flexible and very thin sections can be used as living hinges. As those skilled in the art the invention may be molded from any of a variety of known plastic materials and as new plastic materials are developed in the future such new materials may also be used for the disclosed closures.

In the foregoing embodiment, the tab 7 and associated web are integrally formed on spout 4 as the closure is taken from the mold, leaving a free end for attachment to the tab seat 10. As those skilled in the art appreciate from reading this specification, to form an alternative embodiment, those elements may be reversed in position without departing from the invention. That is, the tab and associated web may be integrally formed in and extending from the region of the closure base where tab seat 10 is currently positioned, as illustrated in FIG. 1 such as extending upright from the inner edge of the raised portion of the cap base illustrated, and the tab seat would be formed on the outer surface of the spout. Such an alternative embodiment is illustrated in FIGS. 7A–7D. In assembly, the spout is placed in its closed position, such as illustrated by FIG. 4, and the tab is then folded over to overlie the tab seat on the outer upper end surface of the spout, after which the tab is welded or otherwise permanently fastened to that seat. In this instance the frangible webs 6 would be connected to the closure base and serve as a pivot for the tab during closure assembly.

In such an embodiment, in order to raise the spout, the frangible web 6 is broken as before. However, this construction leaves the tab in place atop the spout, which appears unsightly. Such an alternative construction appears awkward and less attractive in appearance than the prior embodiment and is therefore less preferred.

Although closures of the foregoing type have been described in connection with a beverage bottle, as those skilled in the art appreciate such closures may be applied to dispensing of any flowable materials ordinarily dispensed by closures in general, whether fluid, granular material or the like. Lotions, conditions, detergents, soaps, toothpaste, honey, salt, pepper and other seasonings are additional examples of the materials that may be dispensed.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification.

As example, in the preferred embodiment, tab 7 is attached to seat 10 by a weld, suitably one created by a sonic welder conventionally used to join plastic components together permanently. However, other suitable means of forming a permanent connection may be substituted, as example, hot air welding, hot blade welding or adhesive bonding.

Further, in the preferred embodiment, the cap was attached to a screw top type bottle, and, hence, a tamper evident ring 2 and its associated webs 3 were employed, and an internal screw thread internal of the closure base was employed to screw the cap onto the bottle. However, where the closure is to be used with another type of bottle, such as a plastic bottle to which the closure may be bonded in place, then those last named elements may be omitted.

As further example, the invention could also be integrated and used in a closure for a flexible wall plastic tube, such as those plastic tubes that are used to dispense toothpaste. As those skilled in the packaging art understand, cylindrical hollow flexible plastic tubes for toothpaste contain a screw on closure, consisting of a hollow threaded plastic stem, through which toothpaste may be extruded, supported in a circular side skirt that is bonded coaxially to an end of the plastic cylinder. And the passage through the hollow stem is closed by a screw-on plastic cap. The foregoing embodiment of the new closure containing the tamper evident spout, can be scaled down in size to fit the end of such hollow plastic toothpaste tube. It can then be bonded to the end of the plastic tube, replacing the described stem and screw-on cap type closure construction and offering the additional benefit of a tamper evident feature.

Thus the invention is to be broadly construed within the full scope of the appended claims.

What is claimed is:

1. A tamper evident closure, comprising:

a base for mounting to a container;

a diaphragm integrally formed with and permanently mounted to said base;

a pivotally moveable spout integrally formed with and permanently mounted to said diaphragm and base to define a unitary one-piece closure, said spout containing a distal end and a proximal end, and said spout being pivotable relative said base between a first position closing a passage there through and a second position to open said passage;

a tab;

a frangible web integrally formed in an end of said tab;

said frangible web connecting a first end of said tab to one of said base or said distal end of said spout, when said spout is initially in said first position;

a tab seat formed in the other one of said base or said distal end of said spout; and a joint permanently attaching said tab to said tab seat to define a visible mechanical strap between said distal end of said spout and said base, said strap appearing continuous;

wherein to pivot said spout from said first position to said second position said frangible web must be broken to produce a discontinuity in said strap, whereby said discontinuity produces visible evidence that said spout has previously been placed in said second position.

2. The invention as defined in claim 1, wherein said one of said base or said distal end of said spout comprises: said distal end of said spout; and wherein said other one of said base or said distal end of said spout comprises: said base.

3. The invention as defined in claim 1, wherein said joint comprises a weld joint.

4. The invention as defined in claim 2, wherein said joint comprises a weld joint.

5. The invention as defined in claim 1, wherein said one of said base or said distal end of said spout comprises: said base; and wherein said other one of said base or said distal end of said spout comprises: said distal end of said spout.

6. The invention as defined in claim 2, wherein said base comprises a pair of upwardly directed protrusions defining a recessed region there between; and wherein said tab seat is located in said recessed region.

7. The invention as defined in claim 1, wherein said frangible web comprises: at least one piece of triangular shape.

8. The invention as defined in claim 1 wherein said frangible web comprises: two pieces of triangular shape, said pieces being spaced from one another, the apex of each triangular shaped piece being connected to one of said base or said distal end of said spout, and the base of each triangular piece being connected to the other of said base or said distal end of said spout.

9. The invention as defined in claim 1 wherein said base, diaphragm, spout, tab, web, and tab seat comprise polypropylene.

10. The invention as defined in claim 1, wherein said one of said base or said distal end of said spout comprises said distal end of said spout, said joint comprises a weld joint, said base further comprises a pair of upwardly directed protrusions defining a recessed region there between and said tab seat is located in said recessed region, said frangible web comprises: two pieces of triangular shape, said pieces being spaced from one another, the apex of each triangular shaped piece being connected to said distal end of said spout, and the base of each triangular piece being connected to said base, and said base, diaphragm, spout, tab, web, tab seat and upwardly directed protrusions comprise polypropylene.

11. In a one-piece spouted dispensing closure formed of one-piece of molded plastic material comprising a closure base, a diaphragm, and a pivotable spout in a unitary one-piece assembly, said spout being pivoted down adjacent said closure base when in the closed position and being pivotable to an upright position when in the open position, the combination therewith comprising with said spout in said closed position: a tab having one end integrally connected to an end edge of said spout by a frangible web and having a bottom face connected to said closure base by a weld, whereby said frangible web breaks when said spout is initially pivoted to the upright position to provide a permanent visible indication thereafter following restoration of said spout a position pivoted down adjacent said closure base that said spout was once moved to said upright position.

12. The method of making a tamper evident spouted closure, said closure including a pivotable spout that is movable between an open position and a closed position, comprising:

molding a spouted closure in one-piece from plastic material with the spout in open position, said spouted closure including a base, diaphragm, a spout, a tab, a tab seat, and a frangible web in a one piece unitary assembly, said spout including a spout end, and said tab and said frangible web being serially attached to and extending from one of said spout end or said base, said tab having one end connected to said frangible web and an opposed end of said tab being unattached;

moving the spout into said closed position and said tab into a position overlying said tab seat; and permanently attaching said tab to said tab seat.

13. The invention as defined in claim 12, wherein said step of permanently attaching said tab to said tab seat comprises the step of ultrasonic welding said tab to said tab seat.

14. The method as defined in claim 13, wherein said tab includes an ultrasonic energy director, and wherein said step of ultrasonic welding said tab to said tab seat includes directing ultrasonic energy through said tab.

15. The method as defined in claim 13, wherein said tab contains an underside surface, said underside surface including a pair of spaced ribs, said ribs extending longitudinally along said underside surface, and wherein said step of ultrasonic welding said tab to said tab seat includes directing ultrasonic energy through said ribs.

16. The method as defined in claim 15, wherein said tab seat comprises a surface containing a series of depressions to define a rough textured surface, and wherein said step of ultrasonic welding said tab to said tab seat includes directing ultrasonic energy through said rough textured surface.

17. The invention as defined in claim 12, wherein said step of permanently attaching said tab to said tab seat comprises the step of hot air welding said tab to said tab seat.

18. The invention as defined in claim 12, wherein said step of permanently attaching said tab to said tab seat comprises the step of hot blade welding said tab to said tab seat.

19. The invention as defined in claim 12, wherein said step of permanently attaching said tab to said tab seat comprises the step of adhesively bonding said tab to said tab seat.

* * * * *